US010590649B1

(12) United States Patent
Morrison et al.

(10) Patent No.: US 10,590,649 B1
(45) Date of Patent: Mar. 17, 2020

(54) ELONGATED CEILING GRID MEMBER AND CEILING GRID ASSEMBLY INCLUDING A PLURALITY OF THE ELONGATED CEILING GRID MEMBER

(71) Applicant: TATE ACCESS FLOORS, INC., Jessup, MD (US)

(72) Inventors: Rachel Elizabeth Morrison, Columbia, MD (US); Daniel Brent Kennedy, Lovettsville, VA (US)

(73) Assignee: TATE ACCESS FLOORS, INC., Jessup, MD (US)

( * ) Notice: Subject to any disclaimer, the term of this patent is extended or adjusted under 35 U.S.C. 154(b) by 0 days.

(21) Appl. No.: 16/354,915

(22) Filed: Mar. 15, 2019

(51) Int. Cl.

| | |
|---|---|
| ***E04B 9/12*** | (2006.01) |
| ***E04B 9/30*** | (2006.01) |
| ***E04B 9/10*** | (2006.01) |
| ***E04B 9/18*** | (2006.01) |

(52) U.S. Cl.
CPC ..... *E04B 9/125* (2013.01); *E04B 9/10* (2013.01); *E04B 9/30* (2013.01); *E04B 9/18* (2013.01)

(58) Field of Classification Search
CPC ..... E04B 9/06; E04B 9/10; E04B 9/12; E04B 9/14; E04B 9/125; E04B 9/127; E04B 9/183; E04B 9/064
See application file for complete search history.

(56) References Cited

U.S. PATENT DOCUMENTS

| | | | | |
|---|---|---|---|---|
| 3,327,438 A * | 6/1967 | Cooper | E04B 2/766 | 52/205 |
| 3,566,561 A * | 3/1971 | Tozer | A47B 96/1466 | 52/127.12 |
| 6,209,275 B1 * | 4/2001 | Cates | E04B 2/7453 | 52/283 |
| 6,615,556 B2 * | 9/2003 | Cates | E04B 2/7457 | 49/504 |
| 2012/0240495 A1 * | 9/2012 | Eychaner | E04B 9/127 | 52/220.6 |

FOREIGN PATENT DOCUMENTS

| | | | |
|---|---|---|---|
| GB | 2167779 A * | 6/1986 | E04B 9/14 |
| GB | 2389376 A * | 12/2003 | E04B 9/068 |
| WO | WO-2008115233 A1 * | 9/2008 | E04B 9/006 |

* cited by examiner

*Primary Examiner* — Christine T Cajilig
(74) *Attorney, Agent, or Firm* — Oliff PLC

(57) ABSTRACT

An elongated ceiling grid member and a ceiling grid assembly that includes a plurality of the elongated ceiling grid members are disclosed. The elongated ceiling grid member may include an upper portion, a lower portion and a middle portion that connects the upper portion and the lower portion. The upper portion may include a first pair of spaced and substantially parallel sidewalls having ridged interior surfaces that face each other. Similarly, the lower portion may include a second pair of spaced and substantially parallel sidewalls. Each sidewall of the second pair of sidewalls may include upper and lower ridged interior surfaces, with the distance between the upper ridged interior surfaces being different than the distance between the lower ridged interior surfaces. A plurality of the elongated grid members can be connected at their ends to form a grid of the plurality of elongated grid members.

20 Claims, 10 Drawing Sheets

ELONGATED CEILING GRID MEMBER AND CEILING GRID ASSEMBLY INCLUDING A PLURALITY OF THE ELONGATED CEILING GRID MEMBER

FIELD OF THE INVENTION

This invention relates to elongated ceiling grid members and to ceiling grid assemblies that include the elongated ceiling grid members and are attached to and suspended from ceilings of rooms and other building spaces, such as office spaces, storage areas, and data centers, to function as the framework for directly and/or indirectly supporting other structural members and/or room or building accessories. In particular, this invention relates to elongated ceiling grid members (1) that can be connected on their ends to form a ceiling grid assembly consisting of parallel and perpendicular rows of the elongated ceiling grid members and (2) to which the other structural members and/or room or building accessories can be attached.

BACKGROUND OF THE INVENTION

Ceiling grid assemblies comprised of a plurality of elongated ceiling grid members connected on their ends to form parallel and perpendicular rows of the elongated ceiling grid members have been in use for decades. Those ceiling grid assemblies are usually directly attached to and suspended from the structure comprising the ceiling of a room or other building space, such as a concrete slab. The elongated ceiling grid members of those ceiling grid assemblies directly or indirectly support other structural members and room or building accessories, such as light fixtures, HVAC conduits, sprinkler systems, etc., in the rooms or other building spaces in which they are installed.

In certain applications, it is desirable that a variety of other structural members and room or building accessories can be attached to or otherwise supported by the elongated ceiling grid members at various locations along the elongated ceiling grid members. That variety of other structural members and room or building accessories may have members for attaching to the elongated ceiling grid members of different sizes.

While elongated ceiling grid members for ceiling grid assemblies have been developed that have the capability that other structural members and room or building accessories can be attached to the elongated ceiling grid members at various locations along the elongated ceiling grid members, there is a need for elongated ceiling grid members to which different sized members can be readily and easily attached and for a ceiling grid assembly that includes such members.

In addition, there is also a need for improved elongated ceiling grid members and ceiling grid assemblies, including with regard to ease of installation, improved stability and strength and/or an improved architectural or aesthetic finish when viewed from underneath the ceiling grid assemblies.

This invention addresses those needs, as well as other needs that are readily apparent to those of skill in the art.

SUMMARY OF THE INVENTION

The elongated ceiling grid members of some embodiments of this invention include an upper portion that extends along the longitudinal axis of the elongated ceiling grid member and is configured to receive and engage one or more fasteners to connect at least two of the elongated ceiling grid members to each other, a lower portion that also extends along the longitudinal axis of the elongated ceiling member and is configured to receive and engage fasteners of different diameters, and a middle portion that connects the upper and lower portions.

In certain embodiments of the elongated ceiling grid members of this invention, the upper portion includes a first pair of spaced and substantially parallel sidewalls that (1) extend parallel to the longitudinal axis of the elongated ceiling grid member and (2) have ridged interior surfaces that face each other, the lower portion includes a second pair of spaced and substantially parallel sidewalls that extend parallel to the longitudinal axis, and the middle portion is configured such that (1) an upper surface of the middle portion and the first pair of sidewalls define a top orifice and (2) a lower surface of the middle portion and the second pair of sidewalls define a bottom orifice. In those embodiments, each sidewall of the second pair of sidewalls includes upper and lower ridged interior surfaces. The upper ridged interior surfaces are first parallel, opposing surfaces and the lower ridged interior surfaces are second parallel, opposing surfaces. The distance between the upper ridged interior surfaces perpendicular to the upper ridged interior surfaces is different than the distance between the lower ridged interior surfaces perpendicular to the lower ridged interior surfaces. In some of those embodiments, the distance between the upper ridged interior surfaces perpendicular to the upper ridged interior surfaces is less than the distance between the lower ridged interior surfaces perpendicular to the lower ridged interior surfaces.

In other embodiments of the elongated ceiling grid members of this invention, the upper ridged interior surfaces of the second pair of sidewalls are located closer to the middle portion than the lower ridged interior surfaces of the second pair of sidewalls.

In yet other embodiments of the elongated ceiling grid members of this invention, each of the lower ridged interior surfaces of the second pair of sidewalls includes a lower end located farthest from the middle portion and first and second elongated flanges are positioned at those lower ends of the lower ridged interior surfaces.

In further embodiments of the elongated ceiling grid members of this invention, the elongated ceiling grid members include an elongated insert that is configured to engage the upper ridged interior surfaces.

The ceiling grid assemblies of some embodiments of this invention include a plurality of the elongated ceiling grid members described above and a plurality of connectors for connecting the plurality of elongated ceiling grid members to form a grid of the plurality of elongated ceiling grid members. In those embodiments of the ceiling grid assembly of this invention, each of the plurality of connectors has at least two arms. Each of the arms (1) is above and parallel to the upper portion of one of the plurality of elongated ceiling grid members and (2) has at least one opening to receive a fastener to fasten the arm to the upper portion.

In certain embodiments of the ceiling grid assemblies of this invention, some of the plurality of the connectors include a nut fillet that extends in a direction opposite from the plurality of elongated ceiling grid members and is configured to receive a threaded end of an elongated member.

In other embodiments of the ceiling grid assemblies of this invention, a first threaded member having a first diameter is connected to the upper ridged interior surfaces of the second pair of sidewalls and a second threaded member having a second diameter is connected to the lower ridged interior surfaces of the second pair of sidewalls, with the second diameter being different than the first diameter. In some of those embodiments, the first diameter is larger than the second diameter.

DETAILED DESCRIPTION

Figure 1:
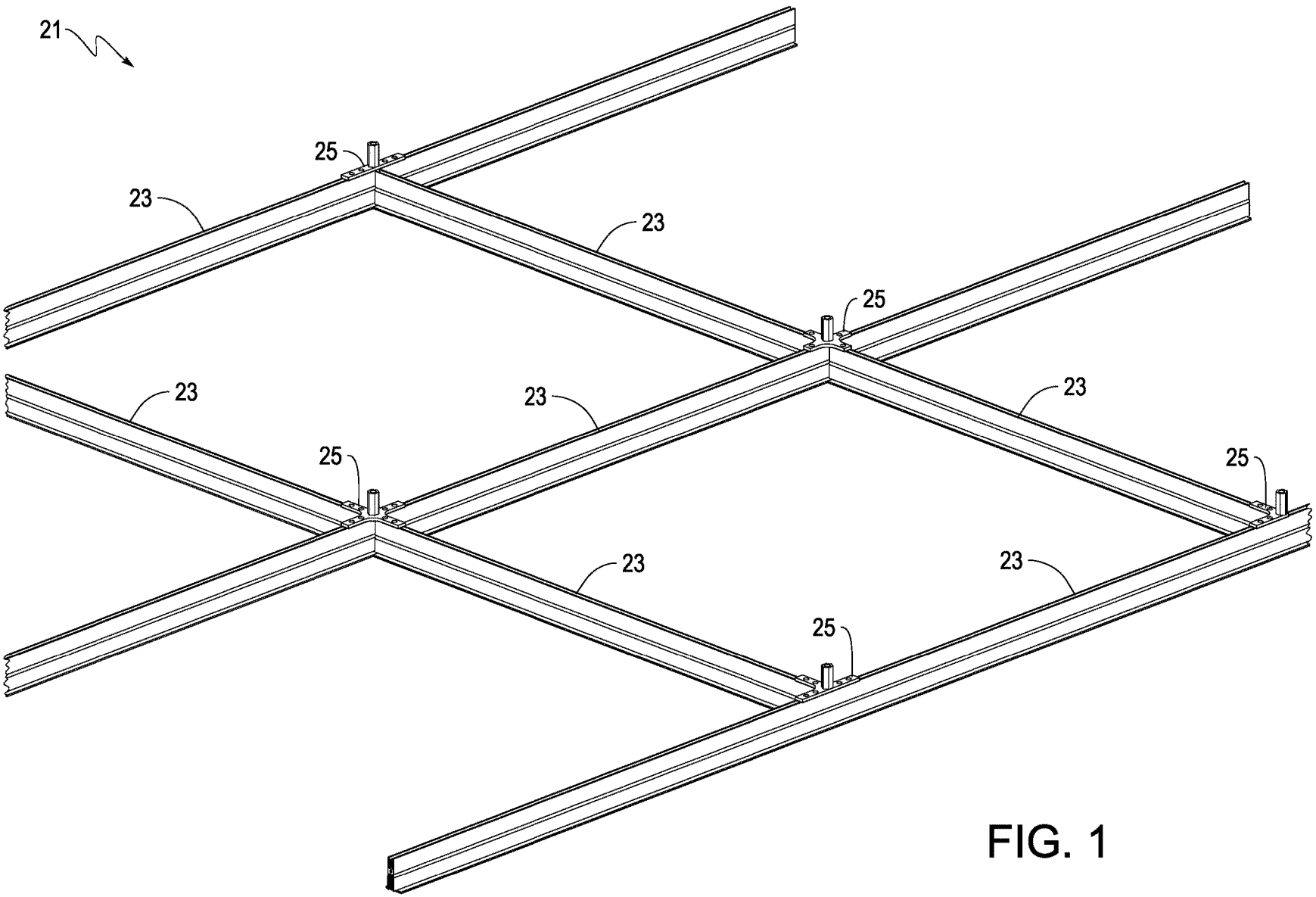
FIG. 1 is a top perspective view of a portion of one embodiment of a ceiling grid assembly of this invention.

As stated, a portion of one embodiment of a ceiling grid assembly of this invention is illustrated in FIG. 1, ceiling grid assembly 21. Ceiling grid assembly 21 includes a number of elongated ceiling grid members 23 joined at their ends by connectors 25 to form a grid of parallel and perpendicular rows of elongated ceiling grid members 23.

Figure 3:
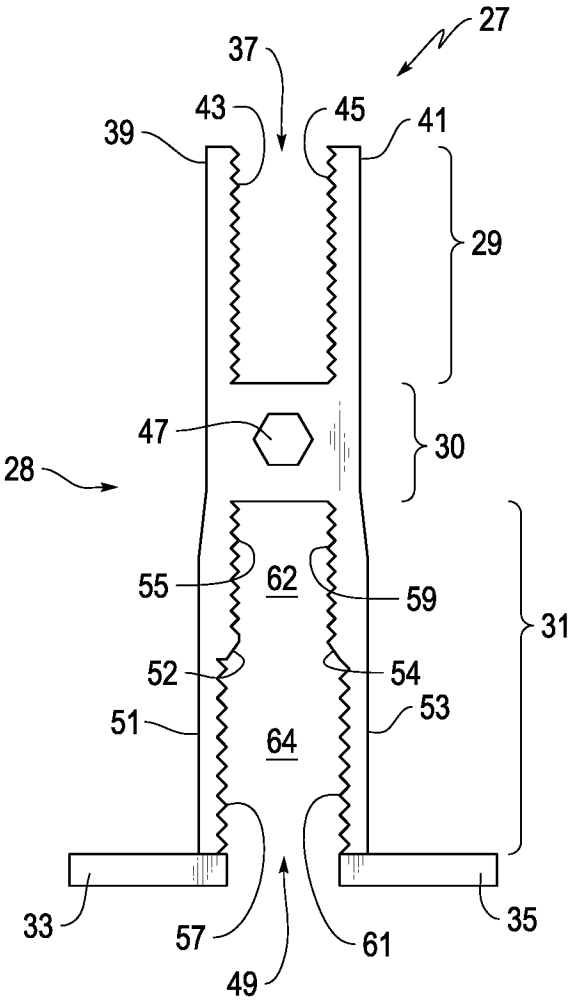
FIG. 3 is an elevation view of one end of the elongated ceiling grid member illustrated in FIG. 2.
Figure 2:
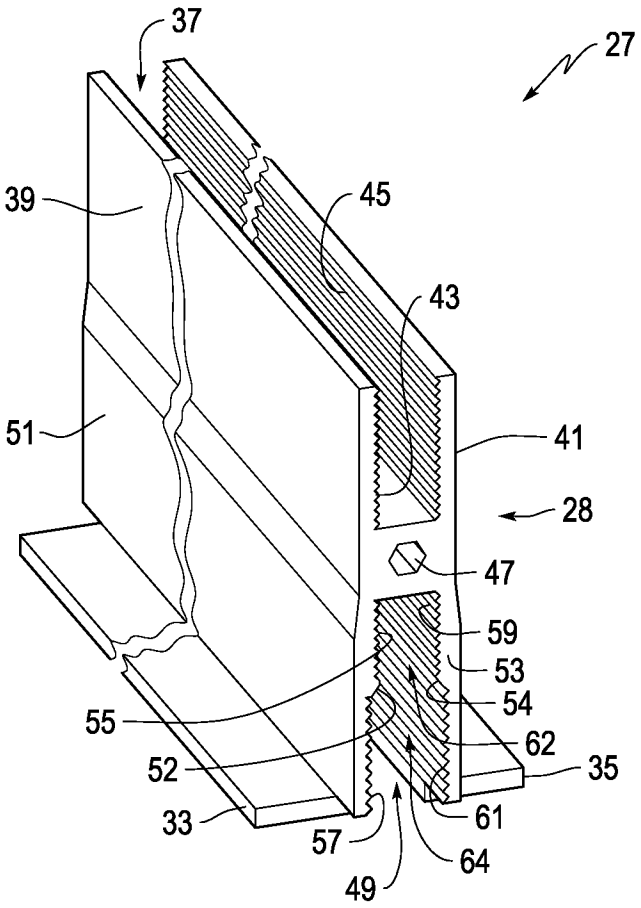
FIG. 2 is a top perspective view of an embodiment of an elongated ceiling grid member of this invention that can be utilized in the ceiling grid assemblies of this invention, including the ceiling grid assembly illustrated in FIG. 1.
Figure 6:
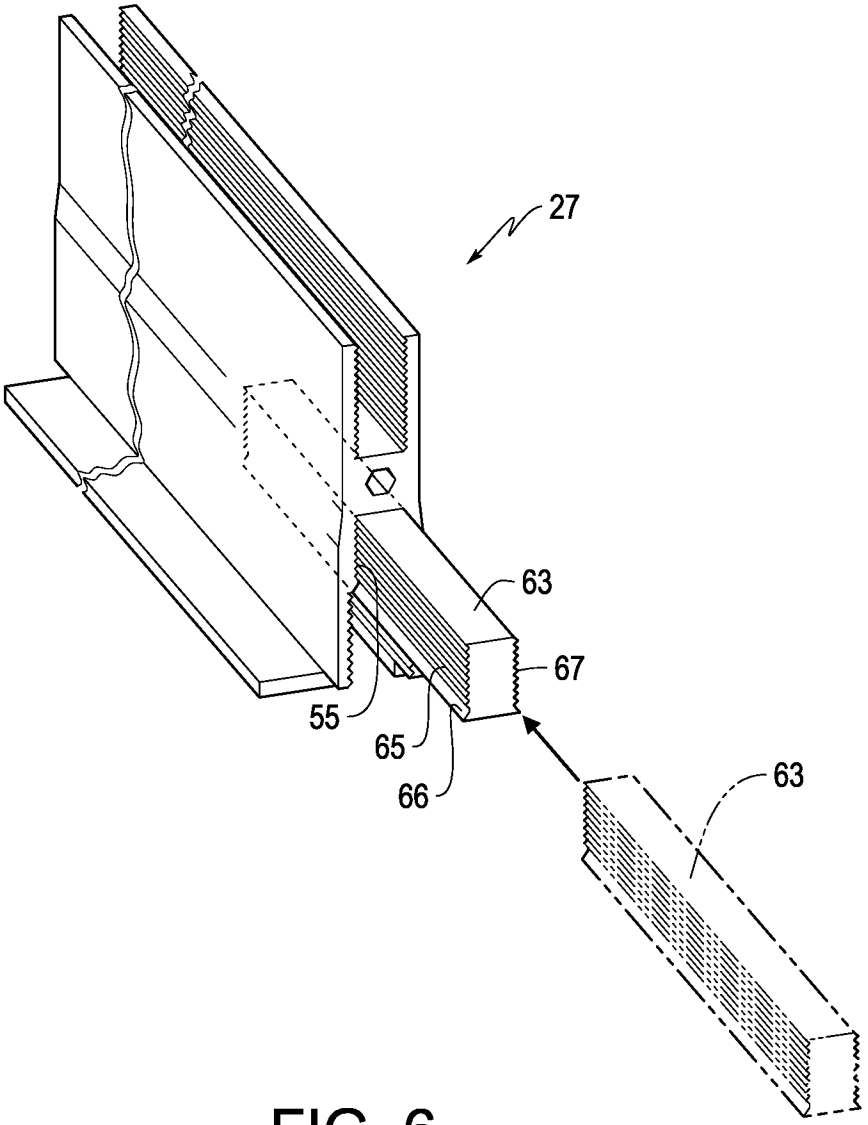
FIG. 6 is a top perspective view of the elongated ceiling grid member illustrated in FIGS. 2 and 3 and the elongated insert illustrated in FIGS. 4 and 5, showing (1) the insertion of the elongated insert into the elongated ceiling grid member and (2) the resulting assembly of the elongated ceiling grid member and the elongated insert.

An embodiment of elongated ceiling grid members 23 is illustrated in FIGS. 2, 3 and 6, elongated ceiling grid member 27.

As shown in those figures, elongated ceiling grid member 27 includes upright section 28 and outwardly extending flanges 33 and 35. Upright section 28, in turn, includes top portion 29, middle portion 30 and bottom portion 31. See, e.g., FIG. 3.

While, in this embodiment of the elongated ceiling grid members of this invention, top portion 29, middle portion 30, bottom portion 31 and flanges 33 and 35 are integral, in other embodiments of the elongated ceiling grid members of this invention, one or more of those portions and flanges can be separate members that are joined to other members that comprise one or more of the other portions and/or flanges. For example, flanges 33 and 35 could be separate from upright section 28, and attached to upright section 28 by welding or other means known in the art.

Top portion 29 and middle portion 30 define upper threaded slot or chamber 37, as follows.

Top portion 29 includes sidewalls 39 and 41, which are spaced apart and substantially parallel. Sidewalls 39 and 41 have ridged or threaded interior surfaces 43 and 45, respectively. Ridged or threaded interior surfaces 43 and 45 form the sidewalls of the upper threaded slot or chamber 37. The top surface of middle portion 30 forms the bottom surface of upper threaded slot or chamber 37. Upper threaded slot or chamber 37 is open at the top.

In this embodiment of the elongated ceiling grid members of this invention, middle portion 30 is solid, except for orifice 47, which extends longitudinally through middle portion 30. Orifice 47 functions as an identifier of the thread "type" that can be received by ridged or threaded interior surfaces 43 and 45 and the ridged or threaded interior surfaces of side walls 51 and 53 of bottom portion 31 (discussed below). Specifically, one shape of orifice 47 identifies that ridged or threaded interior surfaces 43 and 45 and the ridged or threaded interior surfaces of side walls 51 and 53 are compatible with fasteners having imperial threads, and a second shape of orifice 47 identifies that those ridged or threaded surfaces are compatible with fasteners having metric threads.

Bottom portion 31 and middle portion 30 define lower threaded slot or chamber 49, as follows.

Bottom portion 31 includes sidewalls 51 and 53, which are spaced apart and substantially parallel. Sidewalls 51 and 53 have ridged or threaded interior surfaces. Specifically, sidewall 51 includes upper threaded interior surface 55 and lower threaded interior surface 57, and sidewall 53 includes upper threaded interior surface 59 and lower threaded interior surface 61. Upper threaded interior surface 55 is opposite upper threaded interior surface 59, and lower threaded interior surface 57 is opposite lower threaded interior surface 61. Sidewall 51 also includes interior slanted surface 52 that extends between upper threaded interior surface 55 and lower threaded interior surface 57, and sidewall 53 also includes interior slanted surface 54 that extends between upper threaded interior surface 59 and lower threaded interior surface 61.

Upper threaded interior surfaces 55 and 59, interior slanted surfaces 52 and 56, and lower threaded interior surfaces 57 and 61 form the sidewalls of lower threaded slot or chamber 49. The bottom surface of middle portion 30 forms the top surface of the lower threaded slot or chamber 49. Lower threaded slot or chamber 49 is open at the bottom.

As illustrated in the figures, the lateral distance between upper threaded interior surface 55 of sidewall 51 and upper threaded interior surface 59 of sidewall 53 is less than the lateral distance between lower threaded interior surface 57 of sidewall 51 and lower threaded interior surface 61 of sidewall 53. That results in lower threaded slot or chamber 49 being comprised of two sections, inner threaded section 62 between upper threaded interior surfaces 55 and 59 and outer threaded section 64 between lower threaded interior surfaces 57 and 61, with inner threaded section 62 having a shorter lateral distance than outer threaded section 64.

While, in this embodiment of the elongated ceiling grid members of this invention, the upper and lower threaded slots or chambers are formed by pairs of substantially parallel sidewalls, in other embodiments of the elongated ceiling grid members of this invention, the upper and lower threaded slots or chambers can be formed by structure or components other than pairs of substantially parallel sidewalls. In addition, the elongated ceiling grid members of other embodiments of this invention may include any means known in the art, other than threaded slots or chambers, to receive and engage fasteners. The purpose/function of the fasteners are described below.

Flanges 33 and 35 extend outwardly from the lower ends of sidewalls 51 and 53, respectively, and are perpendicular to those sidewalls. In this embodiment of the elongated ceiling grid members of this invention, flanges 33 and 35 are flat plates that do not extend inwardly between sidewalls 51 and 53. In other embodiments of the elongated ceiling grid members of this invention, structure other than flanges can serve as the lowermost surface of the elongated ceiling grid members.

Figure 5:
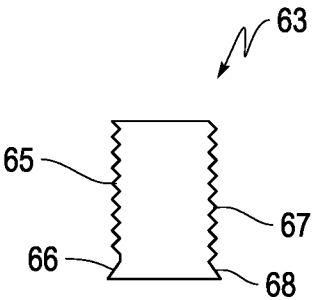
FIG. 5 is an elevation view of one end of the elongated insert illustrated in FIG. 4.
Figure 4:
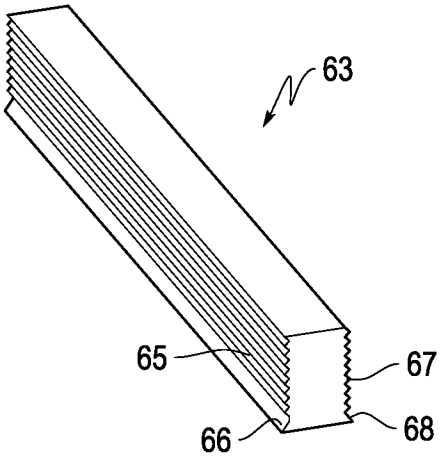
FIG. 4 is a top perspective view of an elongated insert that can be utilized with the elongated ceiling grid member illustrated in FIGS. 2 and 3.

As stated, an elongated insert that can be utilized, when desired and/or necessary, with elongated ceiling grid member 27 is illustrated in FIGS. 4-6, elongated insert 63.

Elongated insert 63 has threaded or ridged sidewalls 65 and 67 and lower slanted surfaces 66 and 68. Lower slanted surface 66 is at the lower end of threaded or ridged sidewall 65, and lower slanted surface 68 is at the lower end of threaded or ridged sidewall 67.

Threaded or ridged sidewalls 65 and 67 are designed to engage upper threaded interior surfaces 55 and 59 of sidewalls 51 and 53, respectively. Lower slanted surfaces 66 and 68 are designed to mate with interior slanted surfaces 52 and 54 of sidewalls 51 and 53, respectively.

Elongated insert 63 is retained in inner threaded section 62 when threaded or ridged sidewalls 65 and 67 engage upper threaded interior surfaces 55 and 59, respectively.

In use, elongated insert 63 is slidably inserted into an end of elongated ceiling grid member 27, as illustrated in FIG. 6, such that the resulting assembly is elongated insert 63 received and retained in inner threaded section 62, between upper threaded interior surfaces 55 and 59, with lower slanted surface 66 of insert 63 facing interior slanting surface 52 of sidewall 51 and lower slanted surface 68 of insert 63 facing interior slanting surfaces 54 of sidewall 53.

The number of elongated inserts 63, and the locations and lengths of those inserts, in a given ceiling grid assembly can vary depending on the application. It may be advantageous to have an elongated insert 63 bridge the end-to-end joinder of two elongated ceiling grid members 27, to provide additional structural stability at the joint. That is, an elongated insert 63 can be received and retained within the inner threaded sections 62 of the end portions of two elongated ceiling grid members 27 arranged end-to-end, spanning the joint between those two members.

While in this embodiment of the elongated ceiling grid members of this invention, elongated insert 63 is retained within inner threaded section 62 by threaded or ridged engagement with upper threaded interior surfaces 55 and 59, in other embodiments of the elongated ceiling grid members of this invention, an elongated insert can be retained in the elongated ceiling grid members by any means known in the art.

Figure 7:
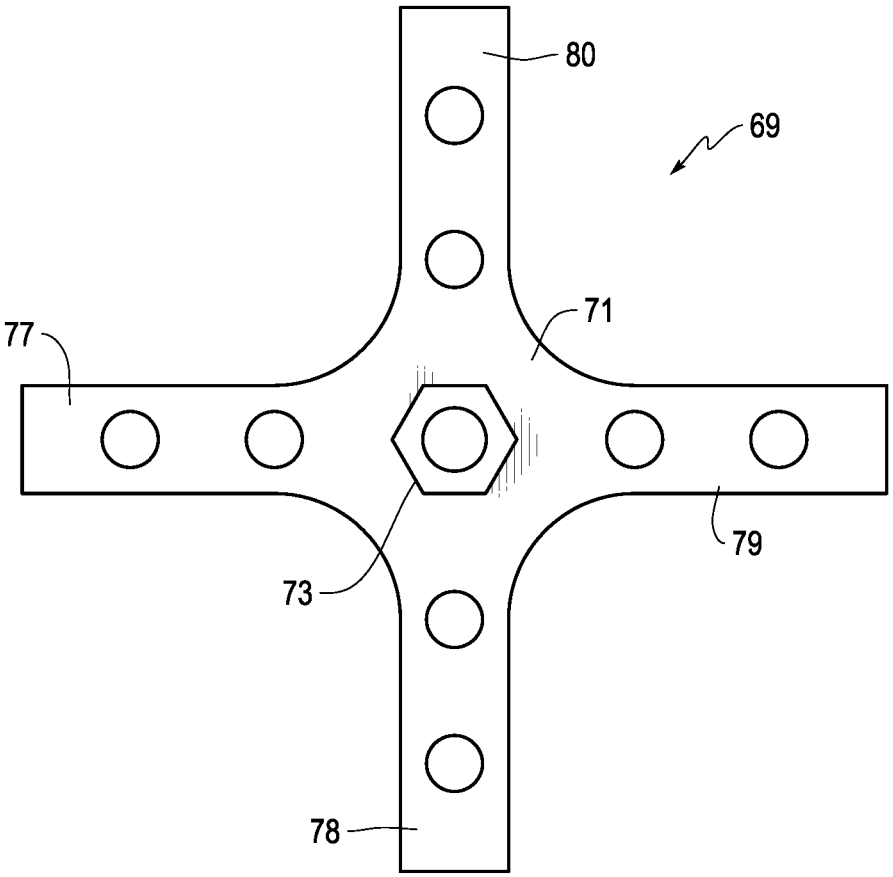
FIG. 7 is a top view of one embodiment of a connector that can be utilized in the ceiling grid assemblies of this invention, including the ceiling grid assembly illustrated in FIG. 1.
Figure 8:
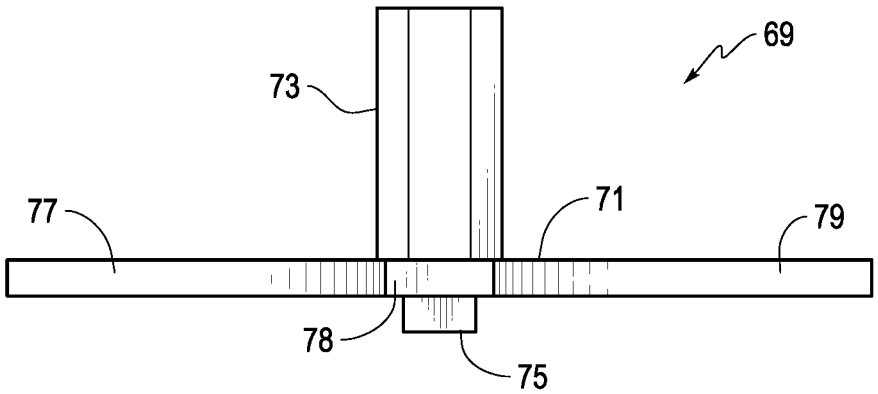
FIG. 8 is a side view of the connector illustrated in FIG. 7.

As stated, one embodiment of a connector that can be used to form the ceiling grid assemblies of this invention, including ceiling grid assembly 21, is illustrated in FIGS. 7 and 8, connector 69. Connector 69 is for use when the ends of four elongated ceiling grid members of this invention, such as elongated ceiling grid members 27, form an intersection.

Connector 69 includes arm portion 71, nut fillet 73 and locating tab 75.

Arm portion 71 includes arms 77-80, positioned at 90° with respect to each other. Each arm 77-80 includes two holes so that fasteners, such as bolts 119 in FIGS. 17 and 18, can be inserted through the holes to fasten connector 69 to the four underlying and intersecting elongated ceiling grid members.

In this embodiment of the ceiling grid assemblies of this invention, each arm 77-80 has two holes. The number of holes in each arm can vary in other embodiments of the ceiling grid assemblies of this invention, and, in certain other embodiments of the ceiling grid assemblies of this invention, there may be different numbers of holes in different arms of the same connector.

Nut fillet 73 is attached to the top surface of arm portion 71, at the intersection of arms 77-80 in the center of arm portion 71, and extends upwardly therefrom. Nut fillet 73 can be welded to the top surface of arm portion 71, or attached to arm portion 71 by any other means known in the art.

Figure 17:
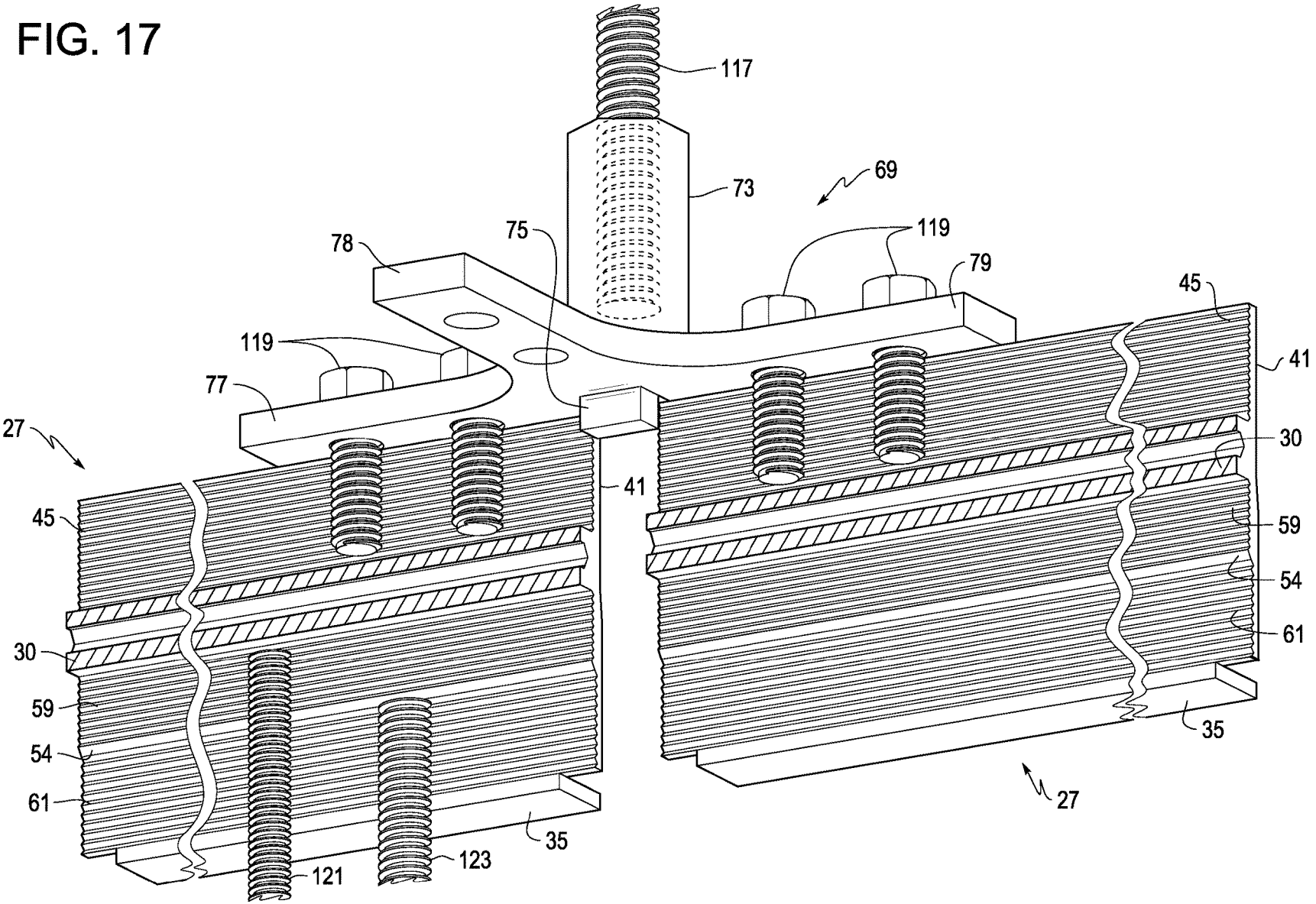
FIG. 17 is a bottom perspective view, partially sectionalized for clarity, showing (a) the connector illustrated in FIGS. 7 and 8 attached to (1) two of the elongated ceiling grid members illustrated in FIGS. 2, 3 and 6 and (2) the lower end of a rod having its upper end attached to a ceiling and (b) threaded members attached to one of the two elongated ceiling grid members.
Figure 18:
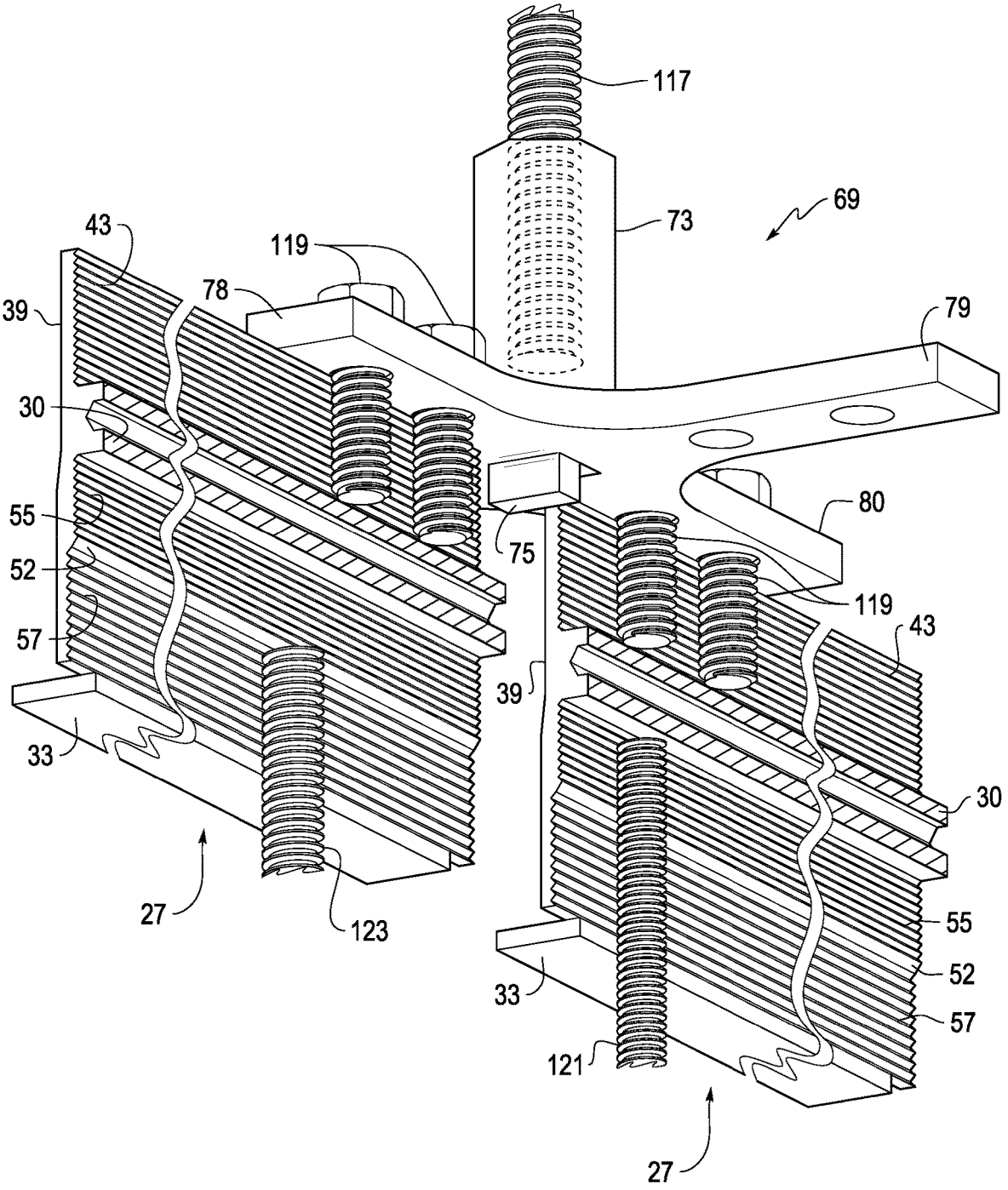
FIG. 18 is another bottom perspective view, partially sectionalized for clarity, showing (a) the connector illustrated in FIGS. 7 and 8 attached to (1) two of the elongated ceiling grid members illustrated in FIGS. 2, 3 and 6 and (2) the lower end of a rod having its upper end attached to a ceiling and (b) threaded members attached to the two elongated ceiling grid members.

Nut fillet 73 has internal threads to receive and threadedly engage a lower threaded end of a rod, such as rod 117 in FIGS. 17 and 18, having its upper end attached to a ceiling, so that connector 69, and the elongated ceiling grid members attached to connector 69, are supported by the ceiling via rod 117.

Locating tab 75 extends downwardly from the center of arm portion 71. The function/purpose of locating tab 75 is described below.

Figure 9:
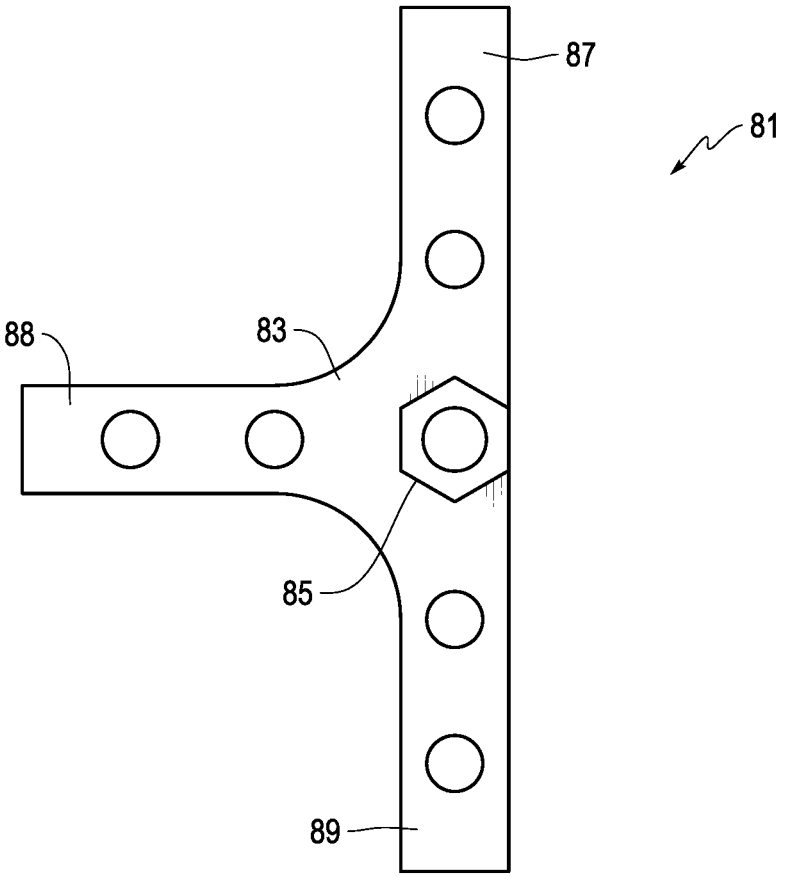
FIG. 9 is a top view of another embodiment of a connector that can be utilized in the ceiling grid assemblies of this invention, including the ceiling grid assembly illustrated in FIG. 1.
Figure 10:
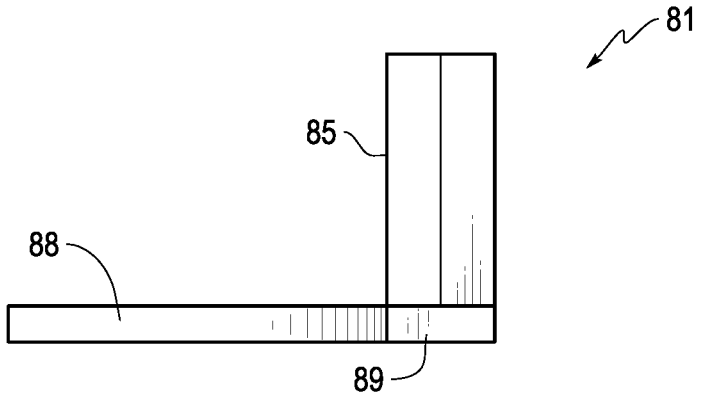
FIG. 10 is a side view of the connector illustrated in FIG. 9.

An embodiment of a connector designed for the perimeter or edge of the ceiling grid assemblies of this invention, including ceiling grid assembly 21, is illustrated in FIGS. 9 and 10, connector 81. Connector 81 is for use when the ends of three elongated ceiling grid members of this invention, such as elongated ceiling grid members 27, form a "T" intersection.

Connector 81 includes arm portion 83 and nut fillet 85.

Because connector 81 is for joining three elongated ceiling grid members 27 in a "T" intersection, arm portion 83 has three arms, arms 87-89. Arms 87 and 89 form a straight line, and arm 88 is perpendicular to arms 87 and 89.

Like arms 77-80 of connector 69, each of arms 87-89 may have one or more holes, so that fasteners, such as bolts 119 in FIGS. 17 and 18, can be inserted through the holes to fasten connector 81 to the three underlying and intersecting elongated ceiling grid members.

Like nut fillet 73 of connector 69, nut fillet 85 (1) is attached to the top surface of arm portion 83 at the intersection of arms 87-89 by welding or any other known attachment means, (2) extends upwardly from arm portion 83, and (3) has internal threads that receive and threadedly engage a threaded lower end of a rod having its upper end attached to a ceiling. Nut fillet 85 may be omitted if it is not necessary or desired to attach connector 81 to a ceiling support.

While not shown in the figures, connector 81 may include a locating tab extending downward from arm portion 83, similar to locating tab 75 of connector 69.

Figure 11:
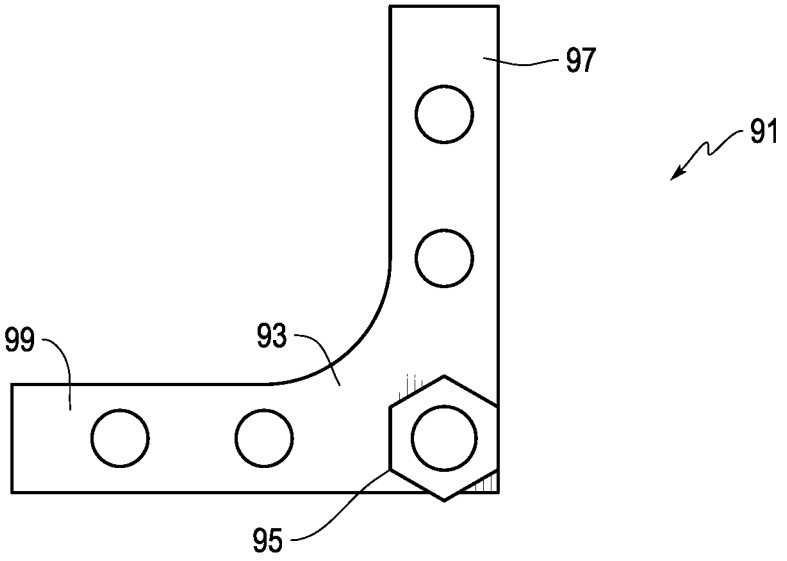
FIG. 11 is a top view of another embodiment of a connector that can be utilized in the ceiling grid assemblies of this invention, including the ceiling grid assembly illustrated in FIG. 1.
Figure 12:
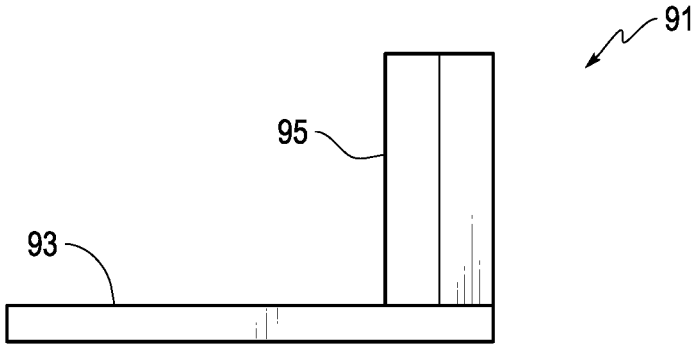
FIG. 12 is a side view of the connector illustrated in FIG. 11.

An embodiment of a connector designed to form a corner of the ceiling grid assemblies of this invention, including ceiling grid assembly 21, is corner connector 91, illustrated in FIGS. 11 and 12. Corner connector 91 is for use when the ends of two elongated ceiling grid members of this invention, such as elongated ceiling grid members 27, need to be connected at a 90° angle.

Connector 91 includes arm portion 93 and nut fillet 95.

Because connector 91 is for joining two elongated ceiling grid member 27 to form a corner of ceiling grid assembly 21, arm portion 93 has two arms, arms 97 and 99, that form a right angle.

Like arms 77-80 of connector 69 and arms 87-89 of connector 81, arms 97 and 99 may have one or more holes, so that fasteners, such as bolts 119 in FIGS. 17 and 18, can be inserted through the holes to fasten connector 91 to the two underlying and perpendicular elongated ceiling grid members.

Like nut fillet 73 of connector 69 and nut fillet 85 of connector 81, nut fillet 95 (1) is attached to the top surface of arm portion 93 at the intersection of arms 97 and 99 by welding or any other known attachment means, (2) extends upwardly from arm portion 93, and (3) has internal threads that receive and threadedly engage a threaded lower end of a rod having its upper end attached to a ceiling. Nut 95 may be omitted if it is not necessary or desired to attach connector 91 to a ceiling support.

While not shown in the figures, connector 91 may include a locating tab extending downward from arm portion 93, similar to locating tab 75 of the connector 69.

Figure 13:
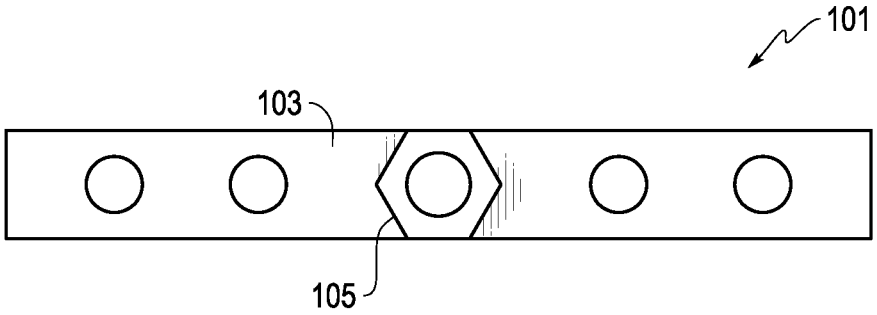
FIG. 13 is a top view of another embodiment of a connector that can be utilized in the ceiling grid assemblies of this invention, including the ceiling grid assembly illustrated in FIG. 1.
Figure 14:
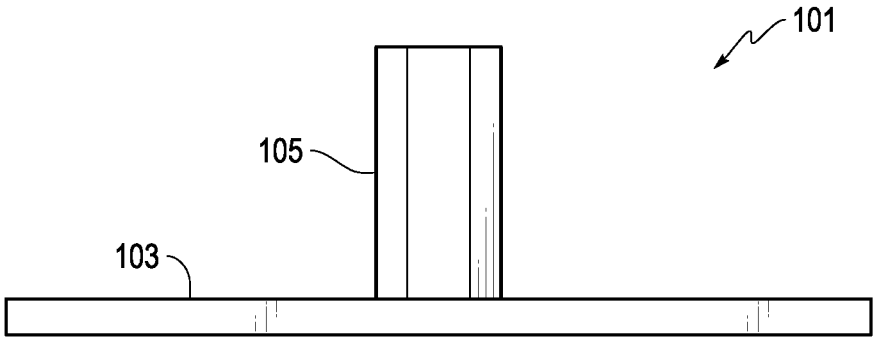
FIG. 14 is a side view of the connector illustrated in FIG. 13.

An embodiment of a connector that can be used in the ceiling grid assemblies of this invention, including ceiling grid assembly 21, to join two elongated ceiling grid members of this invention, such as elongated ceiling grid members 27, end-to-end is illustrated in FIGS. 13 and 14, connector 101.

Connector 101 includes elongated flange 103 and nut fillet 105.

Elongated flange 103 may have one or more holes on each side of nut fillet 105, as desired, so that fasteners, such as bolts 119 in FIGS. 17 and 18, can be inserted through the holes to fasten connector 101 to the two underlying elongated ceiling grid members.

Like nut fillet 73 of connector 69, nut fillet 85 of connector 81 and nut fillet 95 of connector 91, nut fillet 105 (1) is attached to the top surface of elongated flange 103 at the mid-point thereof by welding or any other known attachment means, (2) extends upwardly from elongated flange 103, and (3) has internal threads that receive and threadedly engage a threaded lower end of a rod having its upper end attached to a ceiling. Nut fillet 105 may be omitted if it is not necessary or desired to attach connector 101 to a ceiling support.

While not shown in the figures, connector 101 may include a locating tab extending downward from elongated flange 103, similar to locating tab 75 of connector 69.

Figure 15:
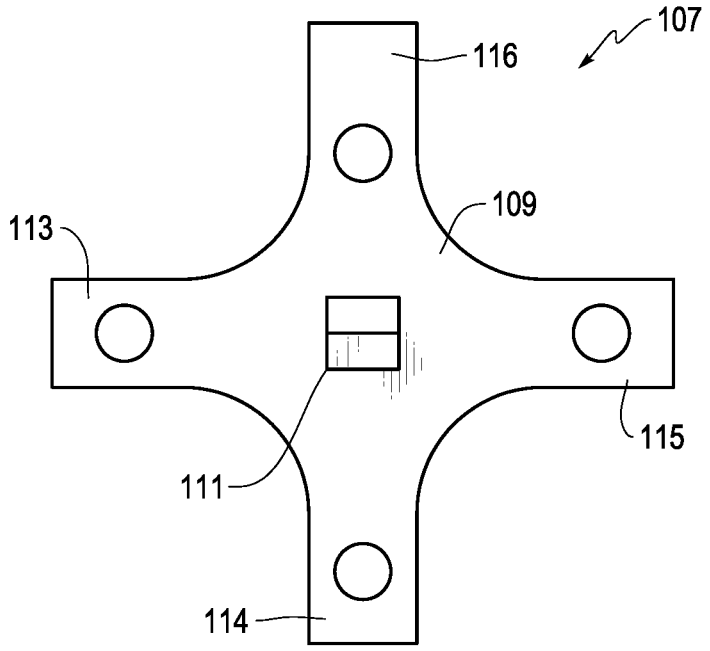
FIG. 15 is a top view of another embodiment of a connector that can be utilized in the ceiling grid assemblies of this invention, including the ceiling grid assembly illustrated in FIG. 1.
Figure 16:
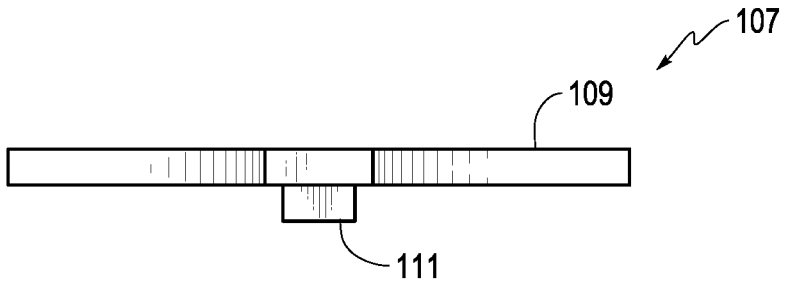
FIG. 16 is a side view of the connector illustrated in FIG. 15.

An embodiment of a connector for the ceiling grid assemblies of this invention, including ceiling grid assembly 21, that is not attached to a rod that is attached to a ceiling is illustrated in FIGS. 15 and 16, connector 107. Like connector 69, connector 107 is for use when the ends of four elongated ceiling grid members of this invention, such as elongated ceiling grid members 27, form an intersection.

Connector 107 includes arm portion 109 and locating tab 111.

Arm portion 109 includes arms 113-116, positioned at 90° with respect to each other. Each arm 113-116 includes at least one hole so that fasteners, such as bolts 119 in FIGS. 17 and 18, can be inserted through the holes to fasten connector 107 to the four underlying and intersecting elongated ceiling grid members.

Locating tab 111 extends downward from the center of arm portion 109. The function/purpose of locating tab 111 is described below.

While in this embodiment of the ceiling grid assemblies of this invention, ceiling grid assembly 21, all the connectors include flat, plate-like arm portions or flanges that are configured to extend along the elongated ceiling grid members being joined and some of the connectors include nut fillets extending upward from those arm portions or flanges, in other embodiments, the connectors can have any shape and structure that enable them to be attached to the elongated ceiling grid members, and, as desired, to a ceiling support.

The ceiling grid assemblies of this invention, such as ceiling grid assembly 21, can be formed as follows.

Connectors are selected that are sufficient to (1) join the ends of the elongated ceiling grid members to form the desired grid of parallel and perpendicular rows of those members, (2) be connected to ceiling supports, as desired, and (3) support the ceiling grid assembly and all accessories and other items attached to or otherwise supported by the ceiling grid assembly, such as connectors 69, 81, 91, 101 and 107.

The individual elongated ceiling grid members, such as elongated ceiling grid members 27, are then attached to the various connectors to form the desired grid of parallel and perpendicular rows of those members, such as in ceiling grid assembly 21.

More specifically, the individual elongated ceiling grid members, such as elongated ceiling grid members 27, may be properly positioned vis-à-vis the connectors with locating tabs, such as connector 69 with locating tab 75 and connector 107 with locating tab 111, as follows. The ends of the elongated ceiling grid members that intersect at those connectors are positioned such that they abut the locating tabs. Notches may be cut or otherwise formed in those ends of side walls 39 and 41 to receive the arms of the connectors.

After an end of an elongated ceiling grid member, such as elongated ceiling grid member 27, is properly positioned vis-à-vis its connector, by its abutment with a locating tab of the connector or otherwise, the end is fastened to the connector. In the case of connectors 69, 81, 91, 101 and 107 and elongated ceiling grid members 27, bolts are inserted through the holes in the arms of the various connectors and the threaded bolt ends are received in and threadedly engage upper threaded slots or chambers 37 of elongated ceiling grid members 27. For example, as shown in FIGS. 17 and 18, bolts 119 are (1) received through holes in arms 77 and 79 (FIG. 17) and arms 78 and 80 (FIG. 18) of connector 69, (2) received in upper threaded slot or chamber 37 of four intersecting elongated ceiling grid members 27 and (3) threadedly engage threaded interior surfaces 43 and 45 of sidewalls 39 and 41, of those four elongated ceiling members 27.

After all the elongated ceiling grid members are attached to all the connectors, the assembled ceiling grid assembly is then attached to a ceiling.

Specifically, all of the connectors having nut fillets are attached to the threaded lower ends of rods having their upper ends attached to a ceiling. In that regard, in ceiling grid assembly 21, nut fillets 73, 85, 95 and 105 of connectors 69, 81, 91 and 101, respectively, are attached to the threaded lower ends of rods having their upper ends attached to a ceiling. For example, as shown in FIGS. 17 and 18, the threaded lower end of rod 117 is threadedly received in and engaged by the internal threads of nut fillet 73 of connector 69. The upper end of rod 117 is attached to a ceiling.

Another way of forming the ceiling grid assemblies of this invention, such as ceiling grid assembly 21, is as follows.

The connectors are selected as discussed above. Then the selected connectors that have nut fillets are attached to the threaded lower ends of rods having their upper ends attached to a ceiling. For example, in ceiling grid assembly 21, nut fillets 73, 85, 95 and 105 of connectors 69, 81, 91 and 101, respectively, are attached to the threaded lower ends of rods having their upper ends attached to a ceiling.

The individual elongated ceiling grid members, such as elongated ceiling grid members 27, are then attached to the various connectors that are attached to the threaded lower ends of the rods attached to the ceiling. Next, connectors that are not attached to the rods connected to the ceiling, such as connector 107, are utilized, as necessary, to complete the ceiling grid assembly.

Once a ceiling grid assembly is fully assembled and attached to a ceiling, various threaded connectors can be attached to the elongated ceiling grid members to support items below the ceiling grid assembly, such as cable trays, hot/cold aisle curtains, lighting and other accessories, as desired.

With regard to elongated ceiling grid members 27, those various threaded connectors threadedly engage either (1) upper threaded interior surface 55 of sidewall 51 and upper threaded interior surface 59 of sidewall 53, which form inner threaded section 62, or (2) lower threaded interior surface 57 of sidewall 51 and lower threaded interior surface 61 of sidewall 53, which form outer threaded section 64.

Because, as stated, the lateral distance between upper threaded interior surface 55 of sidewall 51 and upper threaded interior surface 59 of sidewall 53 is shorter than the lateral distance between lower threaded interior surface 57 of sidewall 51 and lower threaded interior surface 61 of sidewall 53, connectors of different diameters can be received within and engage inner threaded section 62 and outer threaded section 64 of lower threaded slot or chamber 49. For example, as shown in FIGS. 17 and 18, connectors 121 can threadedly engage upper threaded interior surfaces 55 and 59 of inner threaded section 62 and connectors 123 can threadedly engage lower threaded interior surfaces 57 and 61 of outer threaded section 64, with connectors 123 having a larger diameter than connectors 121. That renders ceiling grid assembly 21 capable of supporting accessories and other items having different sized connectors.

In addition, as stated, the ceiling grid assemblies of this invention, such as ceiling grid assembly 21, may include one or more elongated inserts, such as elongated insert 63. Any number and length of elongated inserts 63 may be utilized in any location in the grid of the elongated ceiling grid members 27 that does not receive a connector end in inner threaded section 62. Elongated inserts 63 may fulfill one or more of the following functions: (1) they may provide structural stability, especially at joints, as discussed above; (2) they may act as a vertical stop so that bolts are not threaded too far into lower threaded slot or chamber 49; (3) they may help prevent dirt, dust and other unwanted particles from entering inner threaded section 62; and (4) they may be aesthetically pleasing.

What is described and illustrated herein are preferred embodiments of the invention with some variations. The terms, descriptions and figures are intended to be for illustration only, and are not meant as limitations. Those skilled in the art will recognize that many variations are possible within the scope of the invention, as defined by the following claims.

What is claimed is:

1. An elongated ceiling grid member having a longitudinal axis and comprising:
   - an upper portion that extends along the longitudinal axis and is configured to receive and threadedly engage one or more fasteners along the longitudinal axis to connect at least two of the elongated ceiling grid members;
   - a lower portion that extends along the longitudinal axis and is configured to receive and threadedly engage fasteners of different diameters all along the longitudinal axis; and
   - a middle portion that connects the upper portion and the lower portion.

2. The elongated ceiling grid member of claim 1, wherein:
   - the upper portion includes a first pair of spaced and substantially parallel sidewalls that extend parallel to the longitudinal axis, the first pair of sidewalls having threaded interior surfaces that face each other;
     - the lower portion includes a second pair of spaced and substantially parallel sidewalls that extend parallel to the longitudinal axis; and
     - the middle portion is configured such that (1) an upper surface of the middle portion and the first pair of sidewalls define a top orifice and (2) a lower surface of the middle portion and the second pair of sidewalls define a bottom orifice;
     - each sidewall of the second pair of sidewalls includes upper and lower threaded interior surfaces;
     - the upper threaded interior surfaces are first parallel, opposing surfaces and the lower threaded interior surfaces are second parallel, opposing surfaces; and
     - the distance between the upper threaded interior surfaces perpendicular to the upper threaded interior surfaces is different than the distance between the lower threaded interior surfaces perpendicular to the lower threaded interior surfaces.

3. The elongated ceiling grid member of claim 2, wherein the distance between the upper threaded interior surfaces perpendicular to the upper threaded interior surfaces is less than the distance between the lower threaded interior surfaces perpendicular to the lower threaded interior surfaces.

4. The elongated ceiling grid member of claim 2, wherein the upper threaded interior surfaces of the second pair of sidewalls are located closer to the middle portion than the lower threaded interior surfaces of the second pair of sidewalls.

5. The elongated ceiling grid member of claim 4, wherein:

each of the lower threaded interior surfaces of the second pair of sidewalls includes a lower end located farthest from the middle portion;

the elongated ceiling grid member includes first and second elongated flanges positioned at the lower ends of the lower threaded interior surfaces; and the first and second elongated flanges are substantially perpendicular to the lower threaded interior surfaces, do not extend between the lower threaded interior surfaces, and extend outwardly from the lower threaded interior surfaces.

6. The elongated ceiling grid member of claim 2, wherein the lower portion includes slanted interior surfaces between and connecting the upper and lower threaded interior surfaces of the second pair of sidewalls.

7. The elongated ceiling grid member of claim 2, wherein the threaded interior surfaces of the first pair of sidewalls and the upper and lower threaded interior surfaces of the second pair of sidewalls are configured to threadedly receive and engage threads of threaded members.

8. The elongated ceiling grid member of claim 2, further comprising an elongated insert configured to engage the upper threaded interior surfaces.

9. The elongated ceiling grid member of claim 8, wherein the elongated insert does not extend between the lower threaded interior surfaces when in engagement with the upper threaded interior surfaces.

10. The elongated ceiling grid member of claim 9, wherein:

each of the second pair of sidewalls includes a first slanted interior surface between the upper and lower threaded interior surfaces;

the elongated insert has ridged side surfaces and second slanted surfaces below the ridged side surfaces; and the first slanted surface mates with the second slanted surfaces.

11. A ceiling grid assembly comprising:

a plurality of elongated ceiling grid members having ends, the ends being connected to form a grid of the plurality of elongated ceiling grid members, the elongated ceiling grid members having a longitudinal axis and comprising:

an upper portion that includes a first pair of spaced and substantially parallel sidewalls that extend parallel to the longitudinal axis, the first pair of sidewalls having ridged interior surfaces that face each other;

a lower portion that includes a second pair of spaced and substantially parallel sidewalls that extend parallel to the longitudinal axis; and a middle portion that connects the upper portion and the lower portion and is configured such that (1) an upper surface of the middle portion and the first pair of sidewalls define a top orifice and (2) a lower surface of the middle portion and the second pair of sidewalls define a bottom orifice; and a plurality of connectors for connecting the plurality of elongated ceiling grid members to form the grid of the plurality of elongated ceiling grid members; wherein:

each sidewall of the second pair of sidewalls includes upper and lower ridged interior surfaces;

the upper ridged interior surfaces are first parallel, opposing surfaces and the lower ridged interior surfaces are second parallel, opposing surfaces;

the distance between the upper ridged interior surfaces perpendicular to the upper ridged interior surfaces is different than the distance between the lower ridged interior surfaces perpendicular to the lower ridged interior surfaces;

each of the plurality of connectors has at least two arms; and each of the at least two arms (1) is above and parallel to the upper portion of one of the plurality of elongated ceiling grid members and (2) has at least one opening to receive a fastener to fasten the each of the at least two arms to the upper portion of the one of the plurality of elongated ceiling grid members.

12. The ceiling grid assembly according to claim 11, wherein some of the plurality of connectors include a nut fillet (1) extending in the direction opposite from the plurality of elongated ceiling grid members and (2) configured to receive a threaded end of an elongated member.

13. The ceiling grid assembly according to claim 12, wherein the nut fillet is located at an intersection of the at least two arms.

14. The ceiling grid assembly according to claim 11, wherein at least one of the plurality of connectors includes a locating tab configured to be engaged by at least one of the plurality of elongated ceiling grid members to position the at least one of the plurality of elongated ceiling grid members relative to the at least one of the plurality of connectors.

15. The ceiling grid assembly according to claim 14, wherein an end of the at least one of the plurality of elongated ceiling grid members abuts the locating tab.

16. The ceiling grid assembly according to claim 11, further comprising elongated members having ends attached to the plurality of connectors and a ceiling.

17. The ceiling grid assembly according to claim 11, wherein a first threaded member of a first size is connected to the upper ridged interior surfaces of the second pair of sidewalls and a second threaded member of a second size is connected to the lower ridged interior surfaces of the second pair of sidewalls, with the second size being different than the first size.

18. The ceiling grid assembly according to claim 11, wherein the distance between the upper ridged interior surfaces perpendicular to the upper ridged interior surfaces is less than the distance between the lower ridged interior surfaces perpendicular to the lower ridged interior surfaces.

19. The ceiling grid assembly according to claim 18, wherein a first threaded member of a first size is connected to the upper ridged interior surfaces of the second pair of sidewalls and a second threaded member of a second size is connected to the lower ridged interior surfaces of the second pair of sidewalls.

20. The ceiling grid assembly according to claim 19, wherein the first and second threaded members attach accessories to the plurality of elongated ceiling grid members.

* * * * *